United States Patent [19]

Okamura

[11] 3,990,131

[45] Nov. 9, 1976

[54] CLAMPING DEVICE FOR USE IN PACKAGING

[75] Inventor: Kouich Okamura, Fukuoka, Japan

[73] Assignee: Matsushita Electric Industrial Co., Ltd., Japan

[22] Filed: May 14, 1975

[21] Appl. No.: 577,552

[30] Foreign Application Priority Data

| | | |
|---|---|---|
| May 20, 1974 | Japan | 49-57934[U] |
| May 20, 1974 | Japan | 49-57920[U] |
| May 20, 1974 | Japan | 49-57921[U] |
| May 20, 1974 | Japan | 49-57922[U] |
| Feb. 20, 1975 | Japan | 49-24079[U] |

[52] U.S. Cl. ..... 24/221 R

[51] Int. Cl.[2] ..... A44B 17/00

[58] Field of Search ..... 24/73 RM, 73 PP, 73 SM, 24/221 L, 221 RC, 221 R, 221 A

[56] References Cited

UNITED STATES PATENTS

| | | | |
|---|---|---|---|
| 676,810 | 6/1901 | Young | 24/221 R |
| 718,018 | 1/1903 | Northrop | 24/221 R |
| 1,690,853 | 11/1928 | Behrman | 24/73 PP UX |
| 2,054,519 | 9/1936 | Dzus | 24/221 A |
| 2,309,733 | 2/1943 | Jones | 24/221 A |
| 2,340,250 | 1/1944 | Murphy | 24/221 L |
| 2,373,722 | 4/1945 | Von Opel | 24/221 A |
| 3,121,273 | 2/1964 | Duffy et al. | 24/221 L |
| 3,816,882 | 6/1974 | Maeda et al. | 24/221 R |
| 3,890,753 | 6/1975 | Johansen | 24/73 RM X |

*Primary Examiner*—Donald A. Griffin
*Assistant Examiner*—Andrew M. Calvert
*Attorney, Agent, or Firm*—Burgess Ryan and Wayne

[57] ABSTRACT

The invention discloses a three-piece clamping device especially adapted for clamping together an inner packing box and an outer packing box or clamping together the packing boxes. The clamping device comprises a pair of rectangular retaining members similar in construction and a retaining wedge member with a knob or wing. According to one preferred embodiment, each retaining member has a saucer-shaped flat-bottomed barrel portion formed by a drawing operation, and a flange portion extending outwardly from the periphery of the open end of the barrel portion. An elongated-hexagon-shaped slot is formed through the flat bottom of the barrel portion, a projection is extended outwardly from the outer bottom surface and a recess is formed in the outer bottom surface of the barrel portion. The retaining wedge member has a wedge-shaped portion and a wing- or knob-shaped portion joined to the shorter base of the wedge-shaped portion, the longer base of which is slightly shorter than the length of the elongated-hexagon-shaped slot. The barrel portions of the retaining members are fitted into the holes formed through the side walls of the inner and outer packing boxes in such a manner that the outer bottom surfaces of the barrel portions are made into very close contact with each other and the projections are fitted into the mating recesses. Thereafter the retaining wedge member is inserted into the slots and rotated through 90° so that the retaining members are drawn to each other, thereby clamping the inner and outer packing boxes.

12 Claims, 20 Drawing Figures

CLAMPING DEVICE FOR USE IN PACKAGING

BACKGROUND OF THE INVENTION:

The present invention relates to generally a clamping device, and more particularly a three-piece shipping clamping device for use in clamping together an inner packing box and an outer packing box or a plurality of packing boxes.

In general, the packing bands or belts made of steel or synthetic resin have been used for binding the packing boxes. Therefore there is a fear that the packing bands or belts are loosened or cut off during the shipment. When the packing bands or belts are cut off, they cannot be reused.

There has been devised and demonstrated the packaging method in which the inner and outer boxes are bounded together by means of the clamping or locking devices attached to the peripheries of the boxes. However, when the clamping or locking devices are broken, the inner and outer boxes cannot be bond together even through they may be used.

There has been also proposed a two-piece shipping clamping device of the type comprising a male and female members. The male member has a large-diameter cylindrical portion with the closed bottom and the flange extended outwardly from the periphery of the open end and a small-diameter cylindrical portion extended from the bottom of the large-diameter cylindrical portion coaxially thereof. At the open end of the small-diameter cylindrical section are attached engaging projections which are angularly spaced apart by 180°. The female member has a cylindrical barrel or drawn portion for receiving therein the small-diameter cylindrical portion of the male member, and flange extending outwardly from the bottom of the cylindrical barrel or drawn portion. A hole with diametrically spaced apart recesses for permitting the insertion of the engaging projections is formed through the bottom of the cylindrical barrel portion of the female member. In packing, the barrel portion of the female member is fitted into the hole formed through the side wall of an inner packing box, and the large-diameter cylindrical portion of the male member is fitted into the hole formed through the side wall of an outer packing box in alignment with the hole of the inner box, in such a manner that the small-diameter cylindrical portion of the male member is fitted into the cylindrical barrel portion of the female member and the engaging projections are inserted through the recesses of the hole formed through the bottom of the female member. Therefore, one holds a knob formed within the large-diameter cylindrical portion of the male member to rotate the latter through 90°, thereby clamping together the inner and outer packing boxes. With the use of such clamping devices, the packaging may be much facilitated, but there is a defect that the male and female members cannot be fabricated by the drawing and punching operations because they are too complex in construction. Therefore, two kinds of dies or molds must be prepared with the result of the increase in cost.

SUMMARY OF THE INVENTION

One of the objects of the present invention is therefore to provide shipping clamping devices simple to manufacture at less cost and simple in operation.

Another object of the present invention is to provide a three-piece shipping clamping device comprising a pair of retaining members similar in construction and a wedge-shaped retaining member for clamping the retaining members by the wedge action.

Briefly stated, to the above and other ends, the present invention provides a three-piece shipping clamping device comprising a pair of retaining members similar in construction, each retaining member having a saucer-shaped flat-bottomed barrel portion, a flat flange portion extended outwardly from the periphery of the open end of the barrel portion, an elongated-hexagon-shaped slot formed through the bottom of the barrel portion, a projection extended outwardly from the outer bottom surface of the barrel portion and a recess or hole formed in the outer bottom surface of the barrel portion; and a wedge-shaped retaining member with a wing or knob joined to the shorter base of the wedge-shaped portion, the longer base thereof being slightly shorter than the length of the hexagon-shaped slot of the retaining member. The three-piece shipping clamping devices in accordance with the present invention may be used, for instance, for clamping together an inner packing box and an outer packing box. That is, the barrel portions of the retaining members are fitted into the holes formed through the side walls of the inner and outer boxes in alignment with each other in such a way that the outer bottom surfaces of the barrel portions are made into contact with each other and the projections are fitted into the mating recesses or holes. Thereafter the wedge-shaped portion of the wedge-shaped retaining member is inserted into the slots and rotated through 90°, whereby the inner and outer packing boxes may be firmly clamped to each other.

BRIEF DESCRIPTION OF THE DRAWINGS:

Same reference numerals are used to designate similar parts throughout the figures.

Figure 1A:
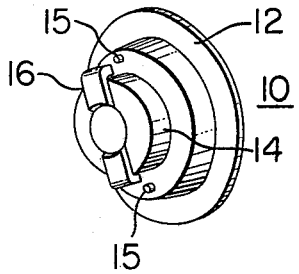
FIG. 1*a* is a perspective view of a male member of a conventional shipping clamping device.
Figure 1B:
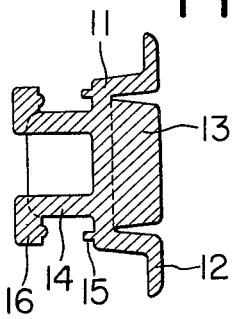
FIG. 1*b* is a sectional view thereof.
Figure 2:
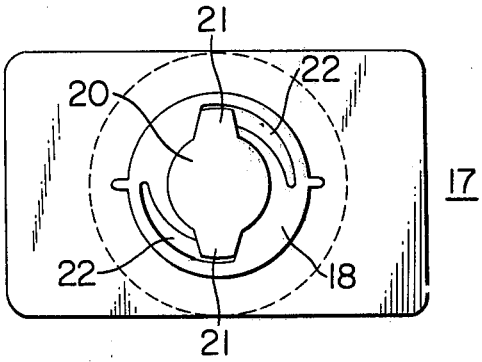
FIG. 2 is a top view of a female member.
Figure 3:
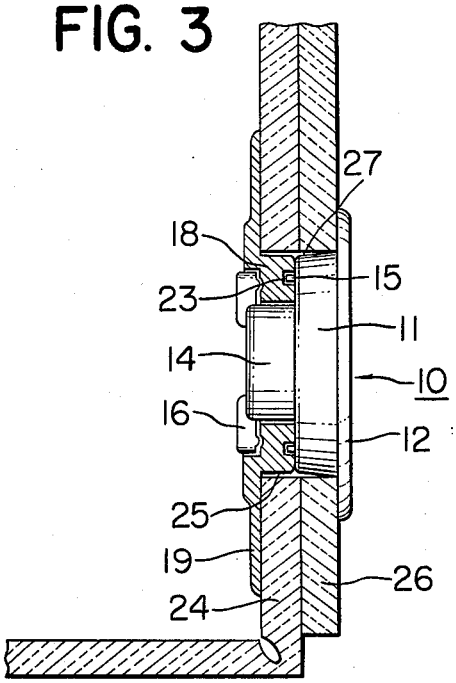
FIG. 3 is a side view, partly in section, of the conventional shipping clamping device used to clamp an inner packing box with an outer packing box.

DESCRIPTION OF THE PREFERRED EMBODIMENTS:

Prior Art, FIGS. 1, 2 and 3

Prior to the description of the preferred embodiments of the present invention, the conventional clamping device used in packaging will be described briefly in order to more specifically point out the defects thereof. The conventional two-piece clamping device comprises, in general, a male member generally indicated by the reference numeral 10 in FIG. 1 and a female member generally indicated by the reference numeral 17 in FIG. 2. The male member 10 comprises a large diameter cylinder section 11 with a flange 12 and a knob 13 extended outwardly from the bottom of the cylinder section 11 and a small-diameter cylindrical section 14 formed integral with the large-diameter cylindrical section 11 in coaxial relation therewith. At the outer bottom or the step between the large-diameter cylinder section 11 and the small-diameter cylindrical section 14 are formed projections or pins 15, and at the top of the small-diameter cylinder section 14 are formed engaging members 16. As shown in FIG. 2, the female member 17 comprises a disk portion 18 with a flange 19 whose thickness is smaller than that of the disk portion 18. The disk portion 18 has an opening 20 into which is fitted the small-diameter cylindrical section 14 of the male member 10, and the opening 20 has radially outwardly extending recesses 21 into which are fitted the engaging members 16 of the small-diameter cylindrical section 14. Arcuate grooves 22 into which are fitted the engaging members 16 are formed in the major surface of the disk portion 18 coplanar with the flange 19 in such a way that the radius of each of the grooves 22 is increased gradually as they are away from the recesses 21. Grooves 23 (See FIG. 3) into which are fitted the projections or pins 15 of the male member 10 are formed in the other major surface of the disk portion 18.

Next referring to FIG. 3, the method for fastening an inner packing box 24 and an outer packing box 26 with the two-piece shipping fastening device with the above construction will be described. Holes 25 and 27 are formed through the boxes 24 and 26, respectively, in coaxial alingment with each other. The disk portion 18 of the female member 17 is fitted into the hole 25 of the inner box 24 with the flange 19 closely pressed against the inner wall surface of the inner box 24, and the small-diameter cylindrical portion 14 and the engaging members 16 of the male member 10 are fitted into the opening 20 and the recesses 21, respectively, when the male member 10 is fitted into the hole 27 of the outer box 26. Thereafter, an operator holds the knob 13 and rotates the male member 10 in the clockwise direction so that the engaging members 16 of the male member 10 are forced to move through the arcuate grooves 22 of the female member 17. Thus, the male and feamale members 10 and 17 are securely interlocked with each other whereby the inner and outer boxes 24 and 26 are fastened to each other.

Since both the male and female members 10 and 17 are complex in construction, they are generally formed by casting or molding so that two pairs of molds one for the male member 10 and the other for the female member 17 must be formed.

First Embodiment, FIGS. 4 through 8

Figure 5:
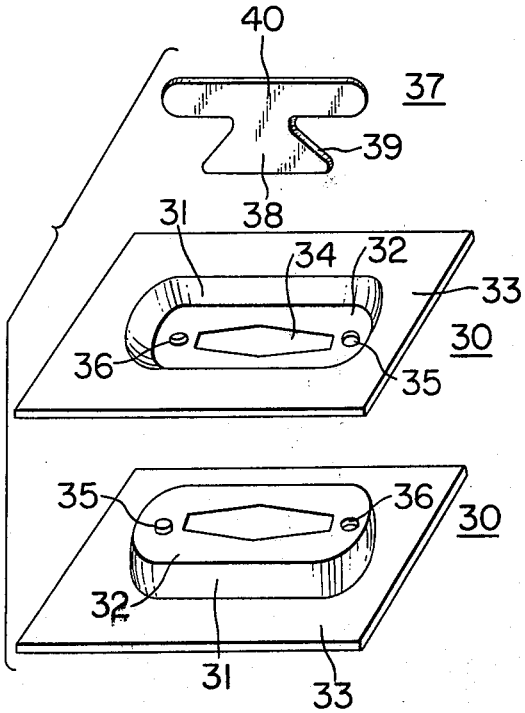
FIG. 5 is an exploded view of the first embodiment.
Figure 4:
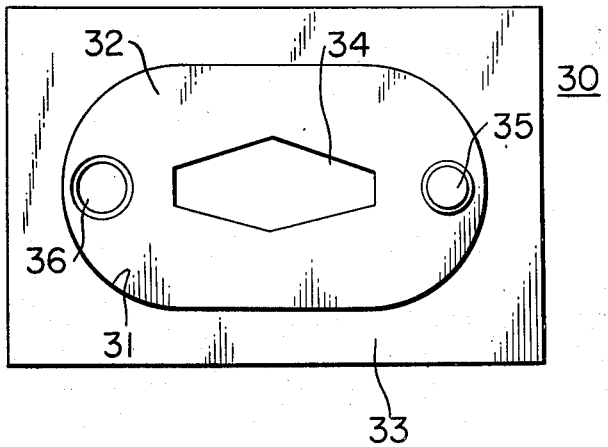
FIG. 4 is a top view of a retaining member of a first embodiment of a shipping clamping device in accordance with the present invention.
Figure 6:
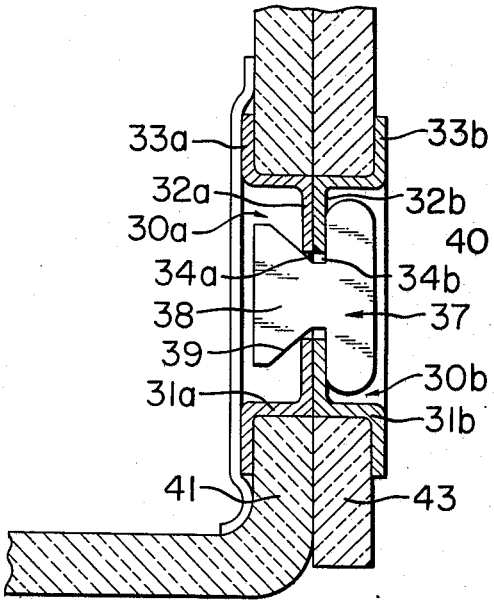
FIG. 6 is a side view thereof used for clamping an inner packing box with an outer packing box.
Figure 7:
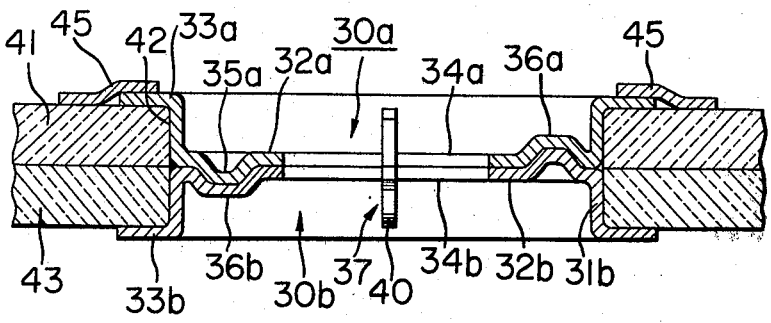
FIG. 7 is a sectional view thereof.

Next referring to FIGS. 4 through 8, the first embodiment of a three-piece shipping clamping device in accordance with the present invention will be described in detail hereinafter. As best shown in FIG. 5, the three-piece clamping device comprises a pair of retaining members **30*a* and 30*b* both similar in construction and a wedge-shaped retaining member 37 to be referred to as the "retaining knob" in this specification. The retaining member 30 is formed by drawing a rectangular steel sheet to have a saucer-shaped barrel or drawn portion 31 with the flat bottom 32 and a flange portion 33 extended outwardly from the periphery of the open end of the saucer-shaped barrel or drawn portion 31. An elongated-hexagon-shaped slot 34 is formed through the bottom 32. The slot 34 is in the form of a hexagon which is slot elongated that it looks like almost a rhombus. Therefore, in this specification the slot 34 will be referred to as the "rhombus-shaped slot" for the sake of simplicity in description. A recess 36 is formed in the bottom of the barrel portion 31, and a projection 35 is extended outwardly therefrom as best shown in FIG. 5 for engagement with the recess 36 of the mating retaining member 30 as shown in FIG. 7.**

The retaining knob 37 has a wedge-shaped portion 38 with upwardly converging sides and a knob or wing portion 40 formed integral with the wedge portion 38 and joined to the shorter base thereof. The bottom or longer base of the wedge portion 38 is slightly shorter than the longer diagonal of the rhombus-shaped slot 34 of the retaining member 30.

Figure 8:
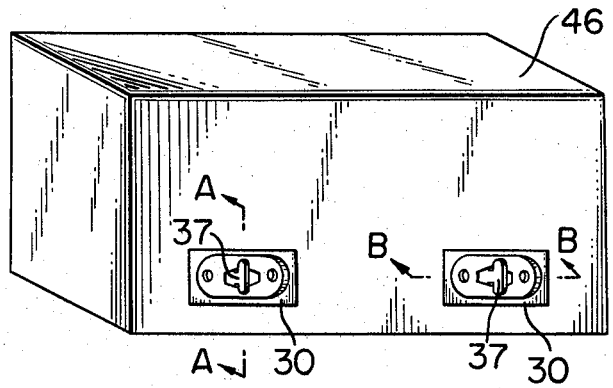
FIG. 8 is a perspective view of a package packed with the shipping clamping devices of the first embodiment.

Next referring particularly to FIGS. 6, 7 and 8, the mode of clamping an inner packing box 41 with an outer packing box 43 with the use of the three-piece shipping clamping device with above construction will be described. The inner and outer boxes 41 and 43 are provided with holes 42 and 44, respectively, which are in alignement with each other when the outer packing box 43 is fitted over or assembled with the inner packing box 41. First the saucer-shaped barrel portion **31*a* of the inner retaining member 30*a* is fitted into the hole 42 of the inner box 41 and held in position with an adhesive tape 45 or the like. Next the barrel portion 31*b* of the outer retaining member 30*b* is fitted into the hole 44 of the outer box 43 so that the projection 35*b* of the outer retaining member 30*b* is fitted into the mating recess 36*a* of the inner retaining member 300*a* and the projection 35*a* of the inner retaining member 30*a* is fitted into the mating recess 36*b* of the outer retaining member 30*b* as best shown in FIG. 7. Thereafter, one inserts the wedge portion 38 of the retaining knob 37 into the elongated slots 34*a* and 34*b* of the inner and outer retaining members 30*a* and 30*b*, and then holds the knob or wing portion 40 to rotate the knob retaining member 37 in either direction so that the inner and outer retaining members 30*a* and 30*b* are drawn to each other under the wedge action. Thus, the bottoms 32***a* and 32*b* of the inner and outer retaining members 30*a* and 30*b* are firmly pressed each other and the flange portions 33*a* and 33*b* are securely pressed against the wall of the inner and outer boxes 41 and 43 as best shown in FIGS. 6 and 7.

As described above, the inner and outer retaining members 30*a* and 30*b* which are similar in construction are clamped to each other by the retaining knob 37 with the projections 35*a* and 35*b* fitted into the mating recesses 36*b* and 36*a*, respectively. Therefore, when a package 46 (See FIG. 8) packed with the use of the clamping devices in accordance with the present invention is lifted, the load is received by the projections 35*a* and 35*b* so that the retaining knob 37 may be prevented from being damaged. Moreover, the saucer-shaped barrel or drawn portion 31 has an oval cross section so that the damages to the peripheries of the holes 42 and 44 of the inner and outer boxes 41 and 43 due to the stress concentration may be prevented. When the retaining knob 37 is rotated at right angles realtive to the longer diagonal of the rhombus-shaped slot 34 of the retaining member 30, the joint between the wedge portion 38 and the knob or wing portion 40 is placed at the vertexes of the shorter diagonal of the rhombus-shaped slot 34 so that the retaining knob 37 may be securely held in clamping position and may be prevented from being rotated and loosened even when the package 46 is subjected to vibration during shipment. It is preferable that the distance between the flange portions 33*a* and 33*b* of the inner and outer retaining members 30*a* and 30*b* be selected shorter than the overall thickness of the walls of the inner and outer boxes 41 and 43 so that the latter may be securely fastented to each other.

To unpack the package 46, one rotates the retaining knob 37 to pull it out through the slots 34*a* and 34*b* of the inner and outer retaining members 30*a* and 30*b* so that the inner and outer boxes 41 and 43 are released from each other.

Figure 9:
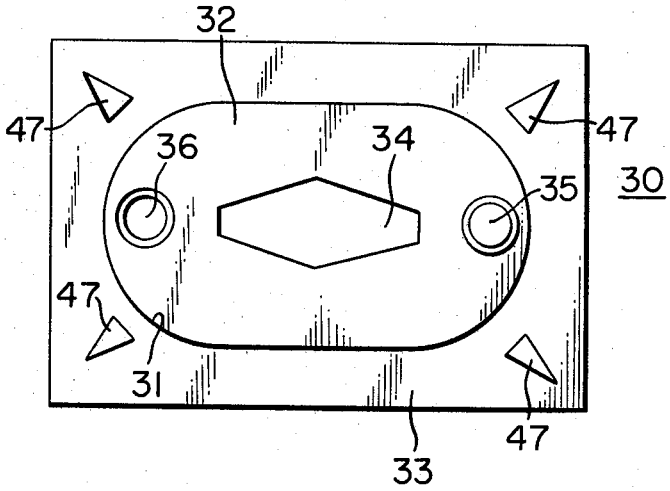
FIG. 9 is a top view of a retaining member of a second embodiment of the present invention.
Figure 10:
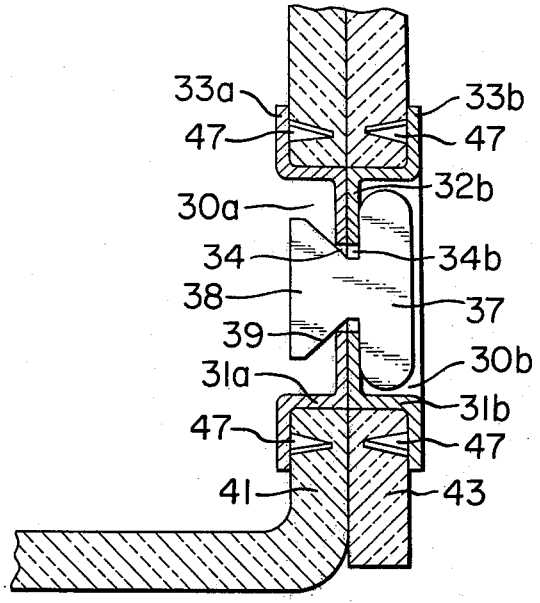
FIG. 10 is a side view of the clamping device of the second embodiment used for clamping an inner packing box with an outer packing box.

Second Embodiment, FIGS. 9 and 10

The second embodiment shown in FIGS. 9 and 10 is substantially similar in construction to the first embodiment except that the retaining member 30 is provided with four sharp-pointed projections or pawls 47 struck out from the flange portion 33 at suitable positions closer to the corners thereof and in parallel with the sauce-shaped barrel or drawn portion 31. Alternatively, the pawls 47 may be attached to the flange portion 33 by welding or the like.

Wheen the inner and outer boxes 41 and 43 are fastened to each other with the shipping clamping devices with the pawls 47, and latter firmly engage with the side walls of the inner and outer boxes 41 and 43 so that the inner retaining members 30*a* may be securely held in position without the use of the adhesive tape 45 of the first embodiment. Furthermore, both the inner and outer retaining members 30*a* and 30*b* may be securely held in position and prevented from coming off even when the package is subjected to vibration during shipment.

Figure 11:
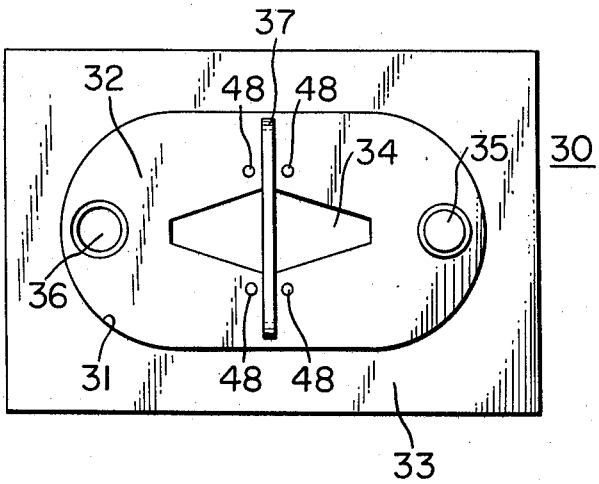
FIG. 11 is a schematic top view of a third embodiment of the present invention.

Third Embodiment, FIG. 11

The third embodiment shown in FIG. 11 is also substantially similar in construction to the first embodiment except that four retaining or stop projections 48 are formed on both sides of the extension of the shorter diagonal of the rhombus-shaped slot 34 of the retaining member 30. Therefore when the retaining knob 37 is rotated through 90° in the manner described hereinbefore, it rides over the retaining projections 48 and is placed between them. Therefore, the third embodiment has the advantages not only that the retaining knob may be securely held in the clamping position but also that one may feel that the retaining knob 37 rides over the retaining projections 48 and is dropped into the clamping position. Since the retaining knob 37 is securely held between the retaining projections 48, it is positively prevented from being loosened during the shipment due to the vibration.

Figure 12:
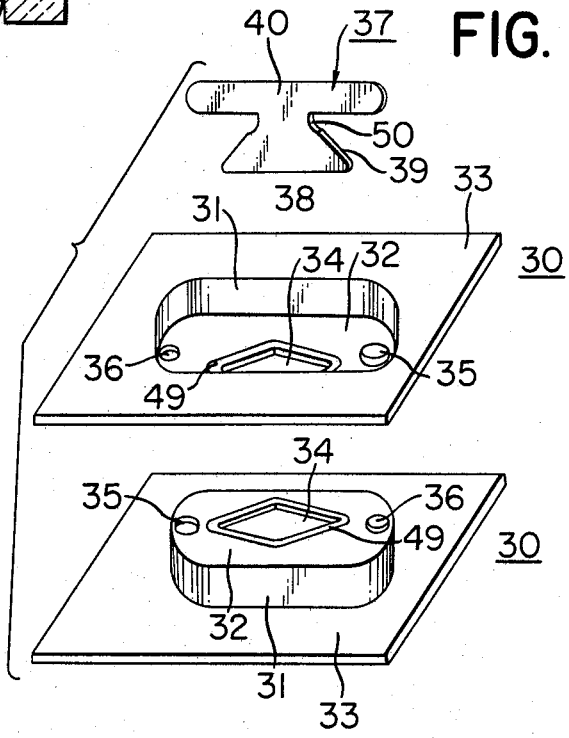
FIG. 12 is an exploded perspective view of a fourth embodiment of the present invention.
Figure 13:
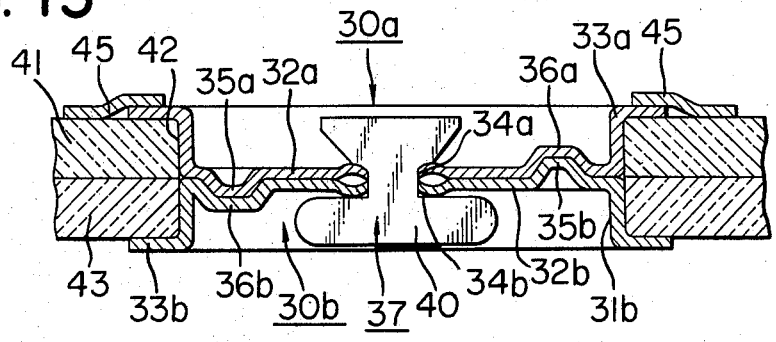
FIG. 13 is a side view, partly in section, thereof used for clamping an inner packing box with an outer packing box.

Fourth Embodiment, FIGS. 12 and 13

The fourth embodiment shown in FIGS. 12 and 13 is also substantially similar in construction to the first embodiment except that the periphery of the rhombus-shaped slot 34 of the retaining member 30 is reinforced with a peripheral ridge 49 and that the retaining knob 37 is provided with undercut portions 50 each formed at the joint between the tapered edge 39 of the wedge portion 38 and the knob or wing portion 40 so that the peripheral edges 49*a* and 49*b* may be fitted into the undercut portions 50 when the retaining knob 37 is rotated to the clamping position as best shown in FIG. 13. Since the rhombus-shaped holes 34*a* and 34*b* of the retaining members 30*a* and 30*b* are reinforced with the peripheral edges 49*a* and 49*b*, the damages to the peripheries of the slots 34 due to the strong clamping forces produced under the wedge action of the retaining knob 37 may be positively prevented. Therefore the fourth embodiment has a distinct advantage over the first to third embodiments that the thickness of the retaining members 30 may be advantageously reduced with the result in reduction in cost.

Figure 14:
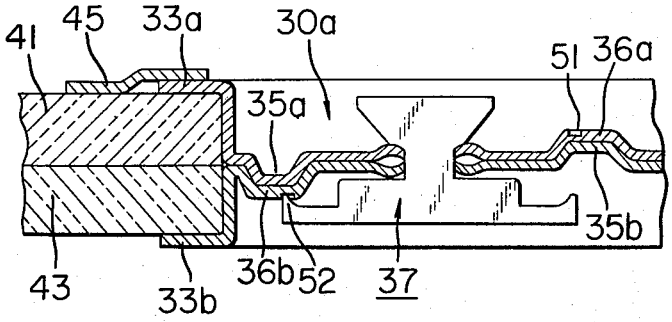
FIG. 14 is a fragmentary perspective view of a retaining member of a fifth embodiment of the present invention.
Figure 15:
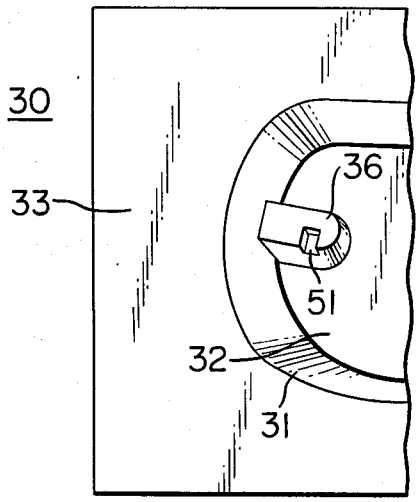
FIG. 15 is a side view, partly in section, thereof in clamping position.

Fifth Embodiment, FIGS. 14 and 15

The fifth embodiment shown in FIGS. 14 and 15 is substantially similar in construction to the first embodiment except that a stop recess 51 is formed in the outer bottom surface of the recess 36 of the retaining member 30 as best shown in FIG. 14 and both ends of the knob or wing portion 40 of the retaining knob 37 have projections 52 for engagement with the stop recess 51 as best shown in FIG. 15. When the retaining knob 37 is rotated through 90° to the fastening position, the projection 52 at either end of the knob or wing portion 40 of the retaining knob 37 engages with the stop recess 51 of the projection 36*b* extended from the inner bottom surface 32*b* of the outer retaining member 30. Therefore the retaining knob 37 may be securely held in clamping position during the shipment.

Figure 16:
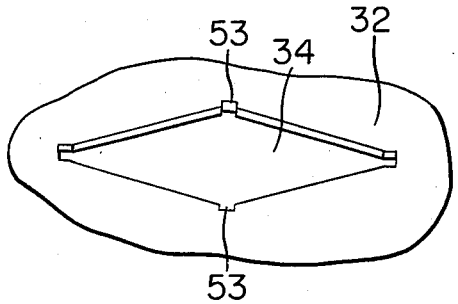
FIG. 16 is a fragmentary view of a retaining member of a sixth embodiment of the present invention illustrating, on enlarged scale, only the essential portion thereof.

Sixth Embodiment, FIG. 16

The sixth embodiment shown in FIG. 16 is substantially similar in construction to the first embodiment except that stop recesses 53 are formed at both vertexes at the ends of the shorter diagonal of the rhombus-shaped slot 34 of the retaining member 32 for engagement with the retaining knob 37 when the latter is rotated through 90° to the fastening position. The sixth embodiment has also an advantage that the retaining knob 37 may be securely held in fastening position.

Figure 17:
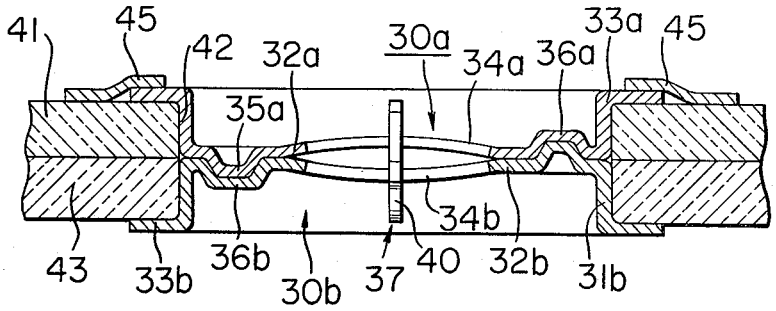
FIG. 17 is a sectional view of a seventh embodiment in clamping position in accordance with the present invention.

Seventh Embodiment, FIG. 17

The seventh embodiment shown in FIG. 17 is substantially similar in construction to the first embodiment except that the bottom 32*a* of the saucer-shaped barrel or drawn portion 31 adjacent to the rhombus-shaped slot 34 is curved inwardly; that is, in the direction of the open end. Since the curved bottoms 34*a* and 34*b* of the retaining members 30*a* and 30*b* are spaced apart from each other as shown in FIG. 17, the more greater fastening force may be produced by the wedge action of the retaining knob 37 so that the retaining members 30*a* and 30*b* and hence the inner and outer boxes 41 and 43 may be more securely fastened to each other.

Figure 18:
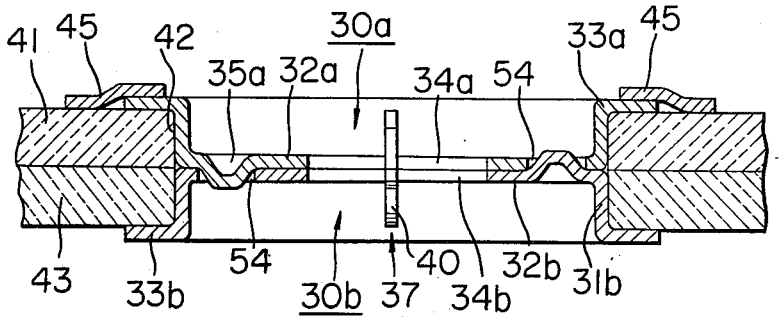
FIGS. 18 and 19 are sectional views of eighth and ninth embodiments of the present invention in clamping position.

Eighth Embodiment, FIG. 18

The eighth embodiment shown in FIG. 18 is also substantially similar in construction to the first embodiment except that instead of the recess 36, a hole 54 is provided for engagement with the projection 35.

Figure 19:
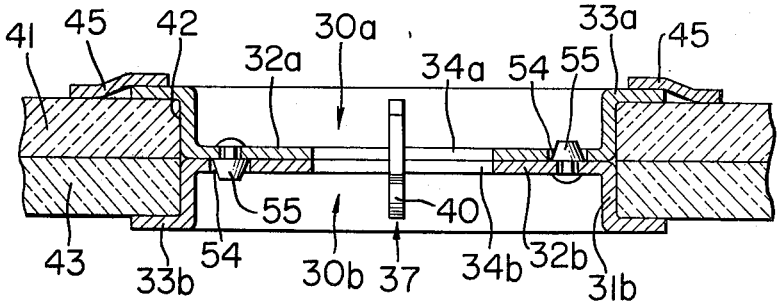

Ninth Embodiment, FIG. 19

The ninth embodiment shown in FIG. 19 is substantially similar in construction to the eighth embodiment except that instead of the projection 35, a rivet 55 is provided for engagement with the mating hole 54. As with the case of the first embodiment, the two retaining members 30*a* and 30*b* of the eighth and ninth embodiments are securely held to each other by the projection-and-hole or rivet-and-hole engagement, and the damages to the retaining knob 37 when the package 46 is lifted may be prevented.

What is claimed is:

1. A three-piece shipping clamping device comprising a. a pair of retaining members similar in construction, each retaining member comprising
a saucer-shaped flat-bottomed barrel portion of an elongated oval cross sectional configuration and with an elongated-hexagon-shaped slot formed through the flat bottom, said hexagon-shaped slot being elongated in the direction of the longer axis of the flat bottom of said barrel portion; and
a flat flange portion extending outwardly from the periphery of the open end of said barrel portion; the barrel portions of said retaining members being fitted into the holes formed through the side walls of an outer packing box and an inner packing box to be fastened and in alingment with each other in such a way that the outer bottom surfaces of said barrel portions may be made into very close contact with each other and the flat flange portions may be pressed against the inner surface of the side wall of the inner box and the outer surface of the side wall of the outer box, respectively; and b. a retaining knob comprising
a wedge-shaped portion, and a knob or wing portion connected to the shorter base of said wedge-shaped portion, the longer base of said wedge-shaped portion being shorter than the length in the elongated direction of said elongated-hexagon-shaped slot,
whereby when said retaining knob is inserted into said elongated-hexagon-shaped slots of said pair of retaining members and rotated through 90° said pair of retaining members may be drawn toward each other, thereby fastening together said outer and inner packing boxes.

2. A three-piece shipping clamping device as set forth in claim 1 wherein
said flange portion is formed integral with said barrel portion; said substantially hexagon-shaped slot is formed by punching; and
a projection and a recess are formed on the outer bottom surface of said retaining member for engagement with the recess and projection of the other retaining member.

3. A three-piece shipping clamping device as set forth in claim 1 wherein
said wedge portion of said retaining knob is formed integral with said knob or wing portion thereof by punching.

4. A three-piece shipping clamping device as set forth in claim 1 wherein
said barrel portion of said retaining member is in the form of an oval.

5. A three-piece shipping clamping device as set forth in claim 1 wherein
a plurality of pawls for engagement with the side wall of a packing box are formed on the surface of said flange portion of said retaining member which is to be pressed against the side wall of the packing box.

6. A three-piece shipping clamping device as set forth in claim 1 wherein
two pairs of stop projections are extended from the inner bottom surface of said barrel portion on the sides of the vertexes at the shortest diagonal of said elongated hexagon-shaped slot each pair being symmetrical about the extension of said shortest diagonal.

7. A three-piece shipping clamping device as set forth in claim 1 wherein
recesses for engagement with said retaining knob are formed at the vertexes interconnected by the shortest diagonal of said elongaged hexagon-shaped slot.

8. A three-piece shipping clamping device as set forth in claim 2 wherein
the periphery of said elongated hexagon-shaped slot is curved to form the peripheral ridge extended toward the open end of said barrel portion.

9. A three-piece shipping clamping device as set forth in claim 2 wherein
instead of said recess, a through hole is formed through the bottom of said barrel portion.

10. A three-piece shipping clamping device as set forth in claim 2 wherein
said projection comprises a rivet; and
instead of said recess, a through hole is formed through the bottom of said barrel portion.

11. A three-piece shipping clamping device comprising a. a pair of retaining members substantially similar in construction, each retaining member comprising
a saucer-shaped flat-bottomed barrel portion,
a flange portion extended outwardly from the periphery of the open end of said barrel portion,
there being an elongated slot formed through the flat bottom of said barrel portion,
a projection extended outwardly from the outer bottom surface of said barrel portion, and
a recess formed in the outer bottom surface of said barrel portion, and
a peripheral ridge formed along the periphery of said elongaged slot; and b. a retaining knob having
a wedge-shaped portion, and
a knob or wing portion joined to the shorter base of said wedge-shaped portion, the longer base of said wedge-shaped portion being shorter than the length of said elongated slot, the corners of said retaining knob where the sides of said wedge-shaped portion are joined to said knob or wing portion being undercut for engagement with said peripheral ridge of said elongated slot.

12. A three-piece shipping clamping device as set forth in claim 11 wherein a stop recess is formed in the bottom of the projection extended inwardly into said barrel portion to define said recess; and a projection for engagement with said stop recess is extended from each end of said knob or wing portion of said retaining member.

* * * * *